United States Patent [19]

Rotar

[11] 4,172,910

[45] Oct. 30, 1979

[54] COATING OF PAPERMAKING FABRICS

[75] Inventor: Frederick D. Rotar, West Chester, Pa.

[73] Assignee: Asten Group, Inc., Devon, Pa.

[21] Appl. No.: 891,046

[22] Filed: Mar. 28, 1978

[51] Int. Cl.[2] ..... B05D 5/00

[52] U.S. Cl. ..... 427/243; 34/116; 427/390 R; 427/428

[58] Field of Search ..... 34/243 F, 95, 111, 116, 34/123; 427/243, 391, 361, 362, 363, 364, 395, 428, 390 R; 162/DIG. 1

[56] References Cited

U.S. PATENT DOCUMENTS

| | | | |
|---|---|---|---|
| 2,432,074 | 12/1947 | Jennings | 427/428 X |
| 3,075,274 | 1/1963 | Mizell | 139/383 A |
| 3,121,660 | 2/1964 | Hall | 162/DIG. 1 |
| 3,196,038 | 7/1965 | Schoch et al. | 427/361 X |
| 3,519,475 | 7/1970 | Hoyle et al. | 139/383 A X |
| 3,594,213 | 7/1971 | Rudman | 427/243 |
| 3,653,961 | 4/1972 | Lefkowitz | 139/383 X |
| 3,751,281 | 8/1973 | Peterson et al. | 427/428 X |
| 3,840,429 | 10/1974 | Busker et al. | 162/DIG. 1 X |

*Primary Examiner*—Shrive P. Beck

*Attorney, Agent, or Firm*—Watson, Cole, Grindle & Watson

[57] ABSTRACT

A process for treating papermaking fabrics, in particular dryer fabrics, includes coating the back surface of the fabric with a thickened resin mixture. To reduce the air permeability of a woven dryer fabric, the fabric is impregnated with a thickened resin mixture to thereby close up a portion of the spaces between the woven yarns. By applying a thickened resin mixture having a viscosity of between 1,000 and 5,000 centipoise to the back surface of the dryer fabric, the fabric is impregnated in a single pass with a sufficient quantity of the mixture to thereby reduce the air permeability to the desirable level.

3 Claims, 8 Drawing Figures

COATING OF PAPERMAKING FABRICS

BACKGROUND OF THE INVENTION

The present invention relates to a process for treating papermaking fabrics, with the primary concern being the treatment of dryer fabrics or felts.

A papermaking machine has three basic sections: fourdrinier or paperforming section, presses and dryers. In each of these sections different types of papermaking fabrics are utilized. The fourdrinier section uses fourdrinier fabrics or paperforming fabrics, the presses use wet felts and the dryers use dryer fabrics or felts. Although the treatment process of the present invention can be used for treating fabrics employed in any of these sections, the process has been primarily developed for treating the dryer fabrics.

During the operation of a papermaking machine, after the paper web has been formed by the fourdrinier section and some of the moisture removed by the press section, the wet paper web is conveyed around the circumference of a plurality of drying cylinders. The wet web, however, is often too weak to support itself, especially during the early stages of drying. Thus, dryer fabrics are employed for conveying the paper web through the drying section. Two exemplary embodiments of such dryer sections are illustrated in FIGS. 1A and 1B of the drawings. In those Figures, drums 1*a* through 1*g* are the drying cylinders, 2*a*, 2*b* and 2*c* are the dryer fabrics and 3 is the wet paper web that is being transported through the drying section. Another function of the dryer fabric is to press the sheet tightly against the cylinder surface thereby increasing the heat transfer between the cylinder and the paper. As the wet paper web moves through the drying section, the heat of the drums causes the moisture within the paper to evaporate. The water vapor evaporates through the openings in the woven dryer fabric.

In recent years, the speeds at which the dryer cylinders are operated have been significantly increased. Such increases in speed have led to certain problems in the operation of such dryer sections, especially with that type of configuration shown in FIG. 1. With increased speeds, air currents are created between the cylinders which, due to high air permeability of the dryer fabric, causes the fabric and the paper web to flutter. Such fluttering can cause stretching of the edges of the paper web, especially with thin papers, which destroys the quality of the paper being produced. In extreme cases, the fluttering also can lead to breaking the paper web thereby necessitating shut-down of the production operation.

The dryer fabrics that are commonly used in the papermaking machine are generally woven with multifilament and mono-filament yarns. Occasionally, glass yarns are also employed. The resulting woven fabric lacks sufficient rigidity. In order to increase the rigidity, such fabrics have been coated with a liquid resin mixture by a kiss coating process. The resin coating also improves the wearing characteristics of the fabrics.

A kiss coating operation is illustrated in FIG. 2. In accordance with this process, a liquid, i.e., low viscosity resin mixture 7 is applied to a dryer fabric 4. Kiss roller 5, which is rotated in a direction opposite the direction of movement of dryer fabric 4, is coated with the liquid resin mixture as it passes through trough 6. The amount of liquid that is applied can be varied by changing the speed of the kiss roller as well as changing the relative speed between the fabric and the kiss roller. The viscosity of the liquid resin mixture that is employed in this process is on the order of between 80 and 200 centipoise.

Typically, before being treated the woven dryer fabric has an air permeability level of between 175 and 800 CFM. In order to significantly reduce the air permeability of a particular dryer fabric, e.g., to a range of approximately 75 CFM, when utilizing the kiss coating process, it was necessary to apply a plurality of coatings to the fabric. Often, it could take up to 25 coating applications before the air permeability of the dryer fabric was reduced to the desired level. In carrying out the plurality of coating operations, after completing each resin application, it was necessary to dry the fabric and then measure the air permeability value to determine if that value had been reduced to a satisfactory level. That process then had to be repeated again until the desired air permeability value was obtained. Such an operation resulted in a large expenditure of both time and energy. Furthermore, it has been found that in the subsequent coating treatments the resin solids were no longer uniformly encapsulating the yarns, but instead were in effect coating the prior treatment. Microscopic examination of such fabrics has shown the creation of crystalized areas, i.e., the solid deposits of the resins cover more than one warp and filling yarn intersection. Thus, resin deposits were often found to be present on both sides of the fabric. The presence of such resin deposits on the front side of the fabric often marred the paper web, especially where thinner papers were being produced.

SUMMARY OF THE INVENTION

An object of the present invention is to provide an improved process for treating papermaking fabrics by coating such fabrics with a thickened resin mixture.

Another object of the present invention is to provide an improved process for treating dryer fabrics by coating such fabrics with a thickened resin mixture in order to significantly reduce the air permeability of such fabrics.

A further object of the present invention is to provide a coating process for coating the back surface of a dryer fabric with a sufficient quantity of an acrylic resin mixture having a viscosity of between 1,000 and 5,000 centipoise in order to significantly reduce the air permeability of the fabric.

Still another object of the present invention is to provide a process for coating the back surface of a dryer fabric in a single treatment to a sufficient extent to significantly reduce the air permeability of the fabric.

All the above-noted objectives can be accomplished by employing the back coating process of the present invention. By utilizing the coating process of the present invention, the air permeability of a dryer fabric can be reduced from a value between approximately 175 and 800 CFM, which are typical values for the air permeability of an untreated woven dryer fabric, to a level between 30.0 and 150 CFM depending on the particular fabric and intended use for the fabric. By so reducing the air permeability level of the fabric, the fluttering effect that occurs when the drying sections are operated at high speeds can be greatly diminished or even entirely eliminated. The resulting problems of poor quality paper and potential breakage of the paper web are thereby avoided.

In accordance with the present invention, a roller applicator applies a thickened resin mixture to the back surface of the dryer fabric to be coated. By the term "thickened resin mixture", it is meant that the resin mixture should have a viscosity significantly higher than the viscosity of the liquid resin mixture employed in the kiss coating process, i.e., significantly higher than 200 centipoise. The roller applicator that is to apply the mixture to the fabric is rotated in a direction parallel to the direction of movement of the fabric. Normally the roller is rotated in the direction opposite the direction of the movement of the fabric. The thickened resin mixture is received by the roller applicator and is then transferred by the applicator to the back surface of the fabric. After the thickened resin mixture has been applied to the fabric, the excess resin mixture is wiped off the fabric by a doctor blade.

In order to achieve the best results in accordance with the present invention, the resin mixture should be sufficiently thickened so that it's viscosity is between 1,000 and 5,000 centipoise. The selected level of the viscosity depends on the particular fabric to be treated. The preferred resin mixture contains an acrylic resin and a thickener and has approximately a 20% solids content.

In accordance with one embodiment of the present invention, the roller applicator passes through a trough that contains the thickened resin mixture. As it passes through the trough, the mixture is coated on the applicator. As the applicator moves into contact with the back surface of the dryer fabric, the mixture is transferred to the fabric.

In one alternative embodiment of the present invention, the thickened resin mixture can be applied to the roller applicator by another roller which passes through the resin mixture within the trough. An extra doctor blade may be provided for metering the amount of resin mixture held on the roller applicator after the mixture has been applied to the applicator but before it has been transferred to the dryer fabric. Additionally, if desired, a back-up roller can be employed for pressing the fabric into contact with the roller applicator. Such a back-up roller is positioned above the fabric at the location in which the fabric contacts the roller applicator. The back-up roller applies pressure against the front surface of the dryer fabric so as to force the back surface of the fabric into better contact with the roller applicator.

DESCRIPTION OF THE PREFERRED EMBODIMENTS

By employing the back coating process of the present invention, the air permeability properties of papermaker fabrics, particularly dryer fabrics or felts, are significantly reduced. A primary advantage achieved by using the back coating process of the present invention is that the woven dryer fabric need only pass through a single resin application.

Figure 5:
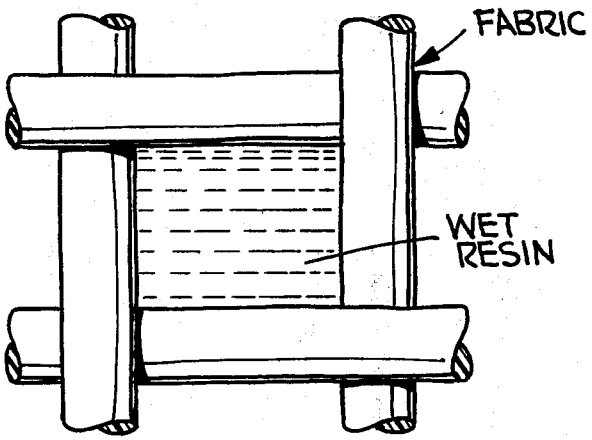
FIG. 5 illustrates a section of a woven dryer fabric impregnated with a thickened resin coating, prior to drying the resin mixture.
Figure 6:
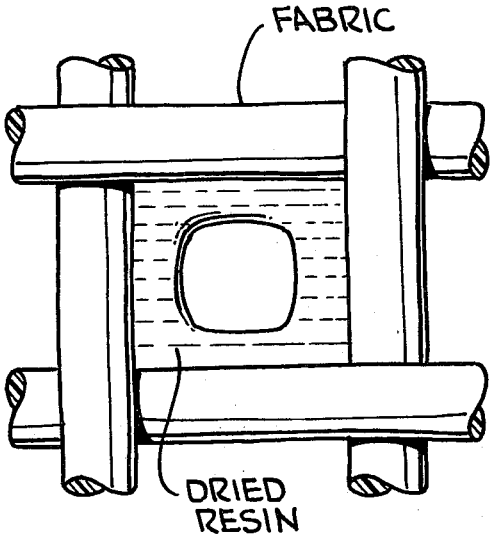
FIG. 6 illustrates the same section of the dryer fabric as FIG. 5 after the thickened resin mixture has dried.
Figure 7:
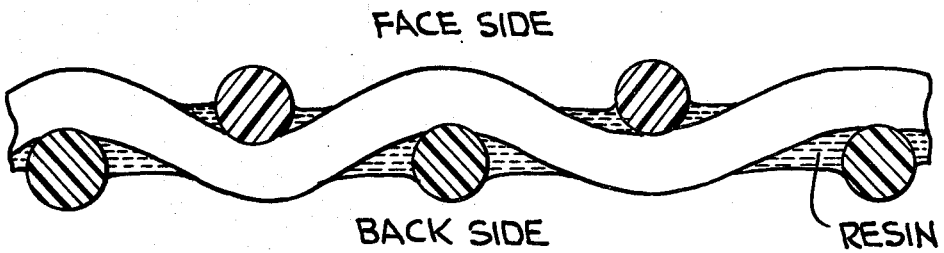
FIG. 7 is a cross-sectional view of a dryer fabric that has been coated in accordance with the process of the present invention.

With reference to FIGS. 5, 6 and 7, the following is a description of the manner in which the desired result is achieved according to the invention. As shown in FIG. 5, the wet resin forms a continuous film over the openings in the woven dryer fabric. When the fabric is dried, the water content of the resin mixture evaporates so that the film breaks and pops open. The solids within the resin migrate to the adjacent yarns as shown in FIG. 6, thereby effectively reducing the weave opening. The quantity of the resin that builds up on the yarns will significantly affect the resulting air permeability value of the treated fabric. Consequently, the level of the resulting air permeability can be controlled by varying the solid contents of the resin mixture. A cross-sectional view of a treated dryer fabric is shown in FIG. 7.

Figure 1A:
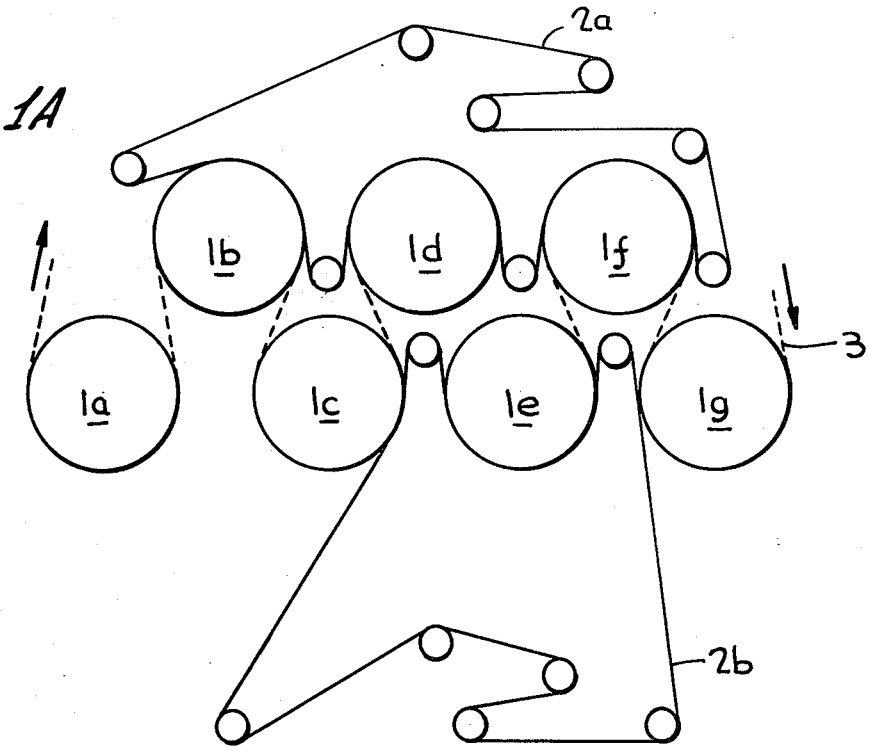
FIGS. 1A and 1B illustrate two different embodiments of a dryer section of a papermaking machine.
Figure 1B:
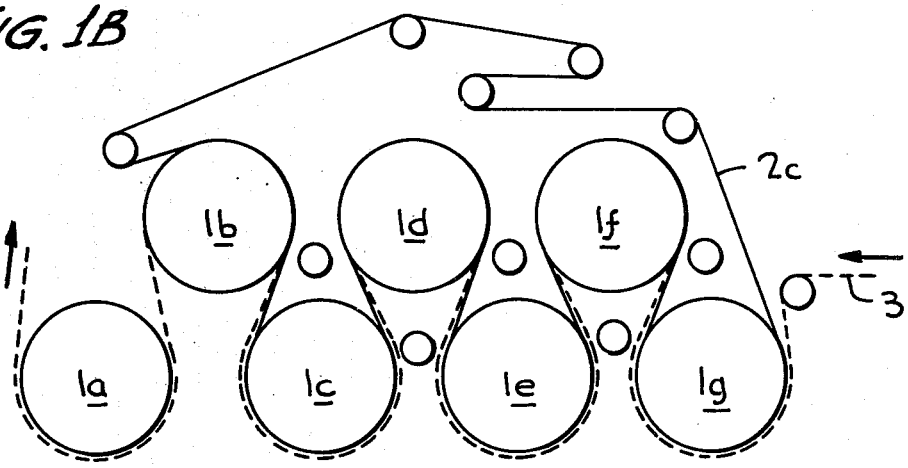
Figure 2:
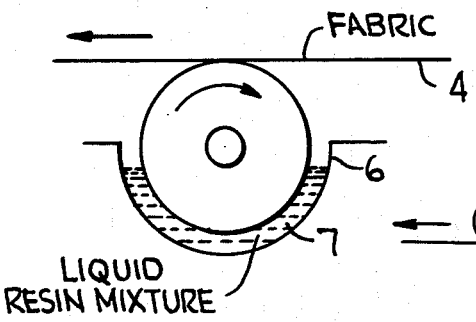
FIG. 2 is a schematic illustration of an embodiment for carrying out a kiss coating process for treating a dryer fabric.
Figure 3:
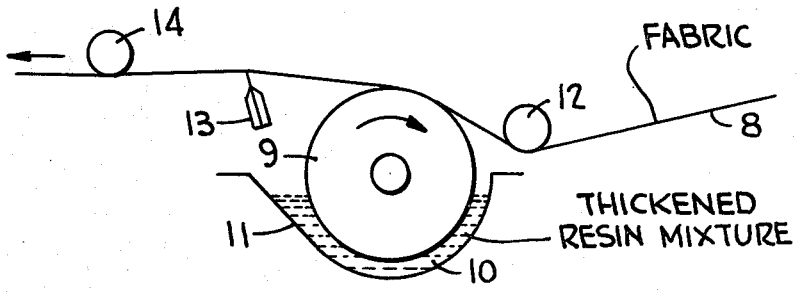
FIG. 3 is a schematic illustration of one embodiment in accordance with the present invention for back coating a dryer fabric.

In the embodiment illustrated in FIG. 3, a dryer fabric 8 to be treated is driven in a first direction so as to pass over and in contact with a roller applicator 9 that is rotated in a direction opposite the movement of the dryer fabric. As roller 9 rotates, it passes through a trough 11 that contains a thickened resin mixture 10. As the roller rotates, it picks up the thickened resin mixture and then applies that mixture to the back surface of the dryer fabric. Immediately after the fabric has been coated, any excess resin is wiped off the fabric by a doctor blade 13. Since the doctor blade is biased against the fabric so as to urge it in an upward direction, two pressure rollers 12 and 14 are used to ensure that the fabric maintains proper contact with roller applicator 9. Pressure roller 12 presses the dryer fabric being treated against roller 9 with enough pressure to ensure that the thickened resin mixture penetrates dryer fabric 8.

The contact pressure and the angle of the doctor blade are controlled in such a manner so as to force the thickened resin mixture into the openings in the woven dryer fabrics. The doctor blade is also positioned over the trough so that any excess resin that is removed from the fabric falls back into the trough.

Generally, the resin mixture may be either of a solvent or water base. In carrying out the present invention, it is considered preferable to use a water base resin mixture. In selecting the resin system it is desirable to use a preparation that will improve the fabric's hydrolysis stability. Normally, the thickened resin mixture includes: dilution water, an anti-foaming agent, surfactants, a catalyst, an acrylic latex, thermal setting resins, a thickner and an ammonium hydroxide neutralizer. While it is preferable to use an acrylic latex in the resin system, other conventional latexes may be used such as: natural or synthetic rubber latexes, vinyl acetates, vinyl chlorides, vinyl pyridines, polyvinyl alcohols and resorcinol formaldehydes.

By adding a thickener, the viscosity of the mixture is increased. The ammonium hydroxide neutralizer serves as a base for activating the thickener. One particular thickener which has been successfully employed is Acrysol ASE-60 sold by Rohm & Haas Company of Philadelphia, Pa. Acrysol ASE-60 is an acid containing, cross-linked acrylic emulsion copolymer. When the emulsion is diluted with water and neutralized with the base, each emulsion particle swells greatly, the emulsion clarifies under such conditions and becomes highly viscous. Other thickeners can also be used, such as starches, polyvinyl alcohols, cellulose gums carboxymethylcellulose and carboxypolymethylene resins.

A sufficient quantity of the thickener is added so as to significantly increase the viscosity in order to provide the desired thickened resin mixture. For a monofilament fabric, the viscosity of the mixture preferably should be increased to a level of between 3,000 and 5,000 centipoise. For a multifilament or a spun yarn the viscosity of the mixture preferably should be increased to a level of between 1,000 to 5,000 centipoise.

By coating the dryer fabric with such a thickened resin mixture with the type of process discussed above, the fabric may be adequately treated in a single pass and yet still reduce the air permeability to the desired level. The resin mixture that is applied only covers the backside of the treated fabric and partially penetrates the fabric, i.e., by properly controlling the operation, the front surface, or face, of the fabric will not be coated with the resin. This factor is particularly advantageous for fabrics that have a soft side composed of spun or continuous filament yarns and another side composed of monofilament yarns. By using such a process, the front surface of the fabric is free of resin contamination which would otherwise alter the surface. The presence of such resin contaminations on the front surface render the surface harsh and rough which leads to undesirable marks on the paper web.

Various factors affect the quantity of the thickened resin mixture that is applied to the back surface of the dryer fabric by the roller applicator. Such factors include the rheology, viscosity and solid contents of the mixture as well as the speed, direction and the contact pressure of the roller applicator against the fabric. Additionally, the contact pressure and angle of the doctor blade will affect the amount of resin that is picked up by the fabric and the uniformity and penetration of such resin within the fabric.

In accordance with a preferred embodiment of the present invention, the thickened resin mixture is prepared by starting with a mixture of the following ingredients: water 74.1% by weight, ammonium sulfamate (a catalyst) 0.5%, Dow DB-110A (an anti-foaming agent) 0.4%; Triton GR5M (a surfactant) 1%, Rhoplex TR 407 (an acrylic latex made by Rohm & Haas) 23% and ammonium hydroxide 1%. The acrylic latex contains 46% solids, approximately 2% emulsifier and approximately 52% water. After those ingredients are mixed, the mixture is sufficiently thickened by an appropriate thickener such as Acrysol ASE-60 to increase the viscosity to the desired level.

Figure 4:
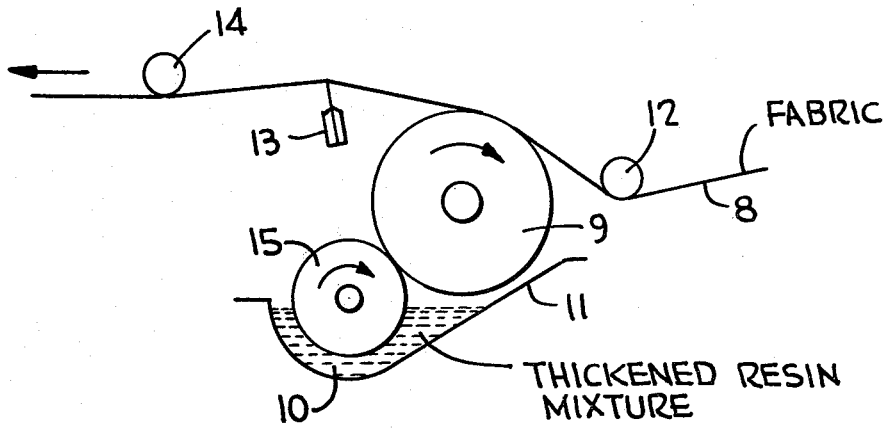
FIG. 4 is a schematic illustration of an alternative embodiment in accordance with the present invention for back coating a dryer fabric.

In an alternative embodiment of the present invention, as illustrated in FIG. 4, the thickened resin mixture is applied to roller applicator 9 by an intermediate roller 15. Other possible modifications to the system can also be made. For example, a back-up roller may be used for pressing the fabric against the roller applicator. Such a back-up roller helps to obtain maximum penetration of the thickened resin mixture into the fabric. Another possible modification is the employment of an extra doctor blade to meter the amount of resin on the roller applicator before the resin is transferred to the fabric.

It is noted that the above description and the accompanying drawings are provided merely to present exemplary embodiments of the present invention and that additional modifications of such embodiments are possible within the scope of this invention without deviating from the spirit thereof.

I claim:

1. A process for treating papermaking fabrics, comprising the steps of: providing an untreated woven fabric having front and back surfaces, said fabric also having openings between yarns of the fabric and an air permeability value of between approximately 175 and 800 CFM; reducing the air permeability value of the fabric to a level between approximately 30 and 150 CFM; the reducing step including: coating the fabric on only said back surface with a thickened liquid resin mixture having a viscosity of between 1,000 and 5,000 centipoise, impregnating the fabric with the thickened resin mixture so as to form a continuous resin film over said openings while maintaining said front surface substantially uncoated, and drying the coated fabric until the liquid content of the film evaporates whereupon the film breaks and pops open in said openings; whereby the reduced air permeability level of the fabric greatly diminishes any fluttering effect when the fabric is used in the dryer section of a papermaking machine, and whereby any marring of a paper web in contact with the uncoated front surface of the fabric is substantially avoided.

2. The process according to claim 1, wherein said coating step is carried out by making only a single pass of the fabric over a resin applicator.

3. The process according to claim 1, wherein the thickened resin mixture has approximately a 20% solids content.

* * * * *